US010869151B2

(12) United States Patent
Suenaga et al.

(10) Patent No.: US 10,869,151 B2
(45) Date of Patent: Dec. 15, 2020

(54) SPEAKER SYSTEM, AUDIO SIGNAL RENDERING APPARATUS, AND PROGRAM

(71) Applicant: SHARP KABUSHIKI KAISHA, Sakai (JP)

(72) Inventors: Takeaki Suenaga, Sakai (JP); Hisao Hattori, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/306,505

(22) PCT Filed: May 31, 2017

(86) PCT No.: PCT/JP2017/020310
§ 371 (c)(1),
(2) Date: Nov. 30, 2018

(87) PCT Pub. No.: WO2017/209196
PCT Pub. Date: Dec. 7, 2017

(65) Prior Publication Data

US 2019/0335286 A1 Oct. 31, 2019

(30) Foreign Application Priority Data

May 31, 2016 (JP) ..... 2016-109490

(51) Int. Cl.
*H04S 7/00* (2006.01)
*H04R 1/40* (2006.01)
(Continued)

(52) U.S. Cl.
CPC ..... *H04S 7/303* (2013.01); *H04R 1/403* (2013.01); *H04R 3/12* (2013.01); *H04R 5/02* (2013.01);
(Continued)

(58) Field of Classification Search
CPC ..... H04S 7/303; H04S 3/008; H04S 2400/01; H04R 1/403; H04R 3/12; H04R 5/02; H04R 5/04
(Continued)

(56) References Cited

U.S. PATENT DOCUMENTS

2013/0223658 A1* 8/2013 Betlehem ..... H04S 3/002 381/307
2014/0056430 A1* 2/2014 Choi ..... H04R 3/12 381/17
(Continued)

FOREIGN PATENT DOCUMENTS

JP 2006-319823 A 11/2006
JP 2012-073313 A 4/2012
(Continued)

OTHER PUBLICATIONS

Rec. ITU-R BS.775-1, Multichannel stereophonic sound system with and without accompanying picture,1992-1994.
(Continued)

*Primary Examiner* — William A Jerez Lora
(74) *Attorney, Agent, or Firm* — ScienBiziP, P.C.

(57) ABSTRACT

The present disclosure is provided with: at least one audio output unit each including multiple speaker units, at least one of the speaker units in each audio output unit being arranged in orientation different from orientation or orientations of the other speaker units; and an audio signal rendering unit configured to perform rendering processing of generating audio signals to be output from each of the speaker units, based on input audio signals, wherein the audio signal rendering unit performs first rendering processing on a first audio signal included in the input audio signals and performs second rendering processing on a second audio signal included in the input audio signals, and the first rendering processing is rendering processing that enhances
(Continued)

a localization effect more than the second rendering processing does.

9 Claims, 12 Drawing Sheets

(51) Int. Cl.
*H04R 3/12* (2006.01)
*H04R 5/02* (2006.01)
*H04R 5/04* (2006.01)
*H04S 3/00* (2006.01)

(52) U.S. Cl.
CPC ..... *H04R 5/04* (2013.01); *H04S 3/008* (2013.01); *H04S 2400/01* (2013.01)

(58) Field of Classification Search
USPC ..... 381/1, 19, 56, 58, 123, 124, 303
See application file for complete search history.

(56) References Cited

U.S. PATENT DOCUMENTS

2014/0126753 A1* 5/2014 Takumai ..... H04R 5/04 381/303
2015/0146897 A1* 5/2015 Yoshizawa ..... H04S 1/002 381/303
2015/0281842 A1* 10/2015 Yoo ..... G06F 3/16 381/80
2017/0195815 A1* 7/2017 Christoph ..... H04S 7/303
2018/0184202 A1* 6/2018 Walther ..... H04R 1/345
2018/0242077 A1* 8/2018 Smithers ..... H04R 1/345

FOREIGN PATENT DOCUMENTS

JP 2013-055439 A 3/2013
JP 2015-508245 A 3/2015
WO WO-2012023864 A1 * 2/2012 ..... H04R 5/02
WO 2013/111034 A2 8/2013
WO 2014/184353 A1 11/2014

OTHER PUBLICATIONS

Pulkki V. "Virtual Sound Source Positioning Using Vector Base Amplitude Panning", Journal of the Audio Engineering Society, 1997, 45(6): 456-466.

* cited by examiner

401

| | | |
|---|---|---|
| TRACK ID | 1 | |
| TRACK CLASSIFICATION | OBJECT BASED | |
| SOUND GENERATING OBJECT POSITION INFORMATION | 0:00:00 −0:01:10 | 0° |
| | 0:00:00 −0:01:10 | 90° |
| | 0:01:10 −0:03:46 | 95° |
| | ... | ... |
| TRACK ID | 2 | |
| TRACK CLASSIFICATION | CHANNEL BASED | |
| OUTPUT CHANNEL | 1 | |
| ... | ... | |

SPEAKER SYSTEM, AUDIO SIGNAL RENDERING APPARATUS, AND PROGRAM

TECHNICAL FIELD

An aspect of the present invention relates to a technique of reproducing multi-channel audio signals.

BACKGROUND ART

Recently, users can easily obtain contents that include multi-channel audio (surround audio) through a broadcast wave, a disc media, such as Digital Versatile Disc (DVD) and Blu-ray (registered trademark) Disc (BD), or the Internet. Movie theaters and the like are often equipped with a stereophonic sound system using object-based audio, such as Dolby Atmos. Furthermore, in Japan, 22.2 ch audio has been adopted as a next generation broadcasting standard. Such phenomena combined have greatly increased chances of users experiencing multi-channel contents.

A variety of channel multiplication methods have been examined even for conventional stereophonic audio signals, A technique of channel multiplication for stereo signals based on a correlation between channels is disclosed, for example, in PTL 2.

Multi-channel audio reproduction systems are not only installed in facilities where large acoustic equipment is installed, such as movie theaters and halls, but also increasingly introduced and easily enjoyed at home and the like. A user (audience) can establish, at home, an environment where multi-channel audio, such as 5.1 ch and 7.1 ch, can be listened to by arranging multiple speakers, based on arrangement criteria (refer to NPL 1) recommended by the International Telecommunication Union (ITU). In addition, a method of reproducing localization of multi-channel sound image with a small number of speakers has also been studied (NPL 2).

CITATION LIST

Patent Literature

PTL 1: JP 2006-319823 A
PTL 2: JP 2013-055439 A

Non Patent Literature

NPL 1: ITU-R BS.775-1
NPL 2: Virtual Sound Source Positioning Using Vector Base Amplitude Panning, VILLE PULKKI, J. Audio. Eng., Vol, 45, No, 6, 1997 June

SUMMARY OF INVENTION

Technical Problem

However, NPL 1 discloses a general speaker arrangement for multi-channel reproduction, hut such arrangement may not be available depending on an audio-visual environment of a user. In a coordinate system where the front of a user U is defined as 0° and the right position and left position of the user are respectively defined as 90° and −90° as illustrated in FIG. 2A, for example, for 5.1 ch described in NPL 1, it is recommended that a center channel 201 is arranged in front of the user U on a concentric circle centering on the user U, a front right channel 202 and a front left channel 203 are respectively arranged at positions of 30° and −30°, a surround right channel 204 and a surround left channel 205 are respectively arranged within the ranges of 100° to 120° and −100° to −120°, as illustrated in FIG. 2B. Note that speakers for channel reproduction are arranged at respective positions, in principle, in a manner in which the front of each speaker faces the user side.

Note that a figure combining a trapezoidal shape and a rectangle shape as illustrated with "201" in FIG. 2B herein indicates a speaker unit, Although, in general, a speaker is constituted by a combination of a speaker unit and an enclosure that is a box, on which the speaker is attached, the enclosure of the speaker is herein not illustrated for better understanding of description unless specifically described otherwise.

However, speakers may not be arranged at recommended positions depending on a user's audio-visual environment, such as the shape of a room and the arrangement of furniture. In such a case, the reproduction result of the multi-channel audio may not be the one as expected by the user.

The details will be described with reference to FIGS. 3A and 3B. It is assumed that a certain recommended arrangement and certain multi-channel audio rendered based on the arrangement are provided. To localize a sound image at a specific position, for example, at a position 303 illustrated in FIG. 3A, multi-channel audio is reproduced basically by making a phantom using speakers 301 and 302 that sandwich this sound image 303 inbetween. The phantom can be made, in principle, on a side where a straight line connecting the speakers exists by adjusting a sound pressure balance of the speakers that make the phantom. Here, in a case that the speakers 301 and 302 are arranged at the recommended positions, a phantom can be correctly made at the position 303 with multi-channel audio that has been generated with an assumption of the same recommended arrangement.

On the other hand, as illustrated in FIG. 3B, a case that a speaker that is supposed to be arranged at a position 302 is arranged at a position 305 that is largely shifted from the recommended position due to the constraints such as the shape of a room or the arrangement of furniture will be considered. The pair of speakers 301 and 305 cannot make a phantom as expected and a user hears as if a sound image is localized at any position on a side of a straight line connecting the speakers 301 and 305, for example, at a position 306.

To solve such a problem, PTL 1 discloses a method of correcting a shift of the real position at which the speaker is arranged from a recommended position by generating sound from each of the arranged speakers, obtaining the sound through a microphone, analyzing the sound, and feeding back a feature quantity acquired by analyzing the sound into an output sound. However, the sound correction method of the technique described in PTL 1 does not necessarily acquire preferable sound correction result since the method does not take into consideration a case that a shift of the position of a speaker is so great that a phantom is made on a laterally opposite side as illustrated in FIG. 3B.

A general acoustic equipment for home theater, such as 5.1 ch, employs a method called "direct surround" where a speaker is used for each channel and an acoustic axis is arranged toward the viewing and listening position of a user. Although such a method makes localization of a sound image relatively clear, the localization position of sound is limited to the position of each speaker and a sound expansion effect and a sound surround effect are degraded compared with a diffuse surround method that uses a lot more acoustic diffusion speakers as used in movie theaters or the like.

An aspect of the present invention is contrived to solve the above problem, and the object of the present invention is to provide a speaker system and a program that can reproduce audio by automatically calculating a rendering method including both functions of sound image localization and acoustic diffusion according to the arrangement of speakers by a user.

Solution to Problem

In order to accomplish the object described above, an aspect of the present invention is contrived to provide the following means. Specifically, a speaker system according to an aspect of the present invention includes: at least one audio output unit each including multiple speaker units, at least one of the speaker units in each audio output unit being arranged in orientation different from orientation or orientations of the other speaker units; and an audio signal rendering unit configured to perform rendering processing of generating audio signals to be output from each of the speaker units, based on input audio signals, wherein the audio signal rendering unit performs first rendering processing on a first audio signal included in the input audio signals and performs second rendering processing on a second audio signal included in the input audio signals, and the first rendering processing is rendering processing that enhances a localization effect more than the second rendering processing does.

Advantageous Effects of Invention

According to an aspect of the present invention, audio that has both sound localization effect and sound surround effect can be brought to a user by automatically calculating a rendering method including both functions of sound image localization and acoustic diffusion according to the arrangement of speakers arranged by a user.

DESCRIPTION OF EMBODIMENTS

The inventors arrived at the present invention by focusing that a preferable sound correction effect cannot be achieved by a conventional technique in a case that the position of a speaker unit is shifted so large that a sound image is generated laterally opposite side and such an acoustic diffuse effect as can be achieved by a diffuse surround method used in a movie theater or the like cannot be achieved by only a conventional direct surround method, and finding that both functions of sound image localization and acoustic diffusion can be realized by switching and performing multiple kinds of rendering processing according to a classification of a sound track of multi-channel audio signals.

In other words, a speaker system according to an aspect of the present invention is a speaker system for reproducing multi-channel audio signals. The speaker system includes: an audio output unit including multiple speaker units in which at least one of the speaker units is arranged in orientation different from orientation of the other speaker units; an analysis unit configured to identify a classification of a sound track for each sound track of input multi-channel audio signals; a speaker position information acquisition unit configured to obtain position information of each of the speaker units; and an audio signal rendering unit configured to select one of first rendering processing and second rendering processing according to the classification of the sound track and perform the selected first rendering processing or second rendering processing for each sound track by using the obtained position information of the speaker units. The audio output unit outputs, as physical vibrations, the audio signals of the sound track on which the first rendering processing or the second rendering processing is performed.

In this way, the inventors realized provision of audio that has both sound localization effect and sound surround effect to a user by automatically calculating a rendering method including both functions of sound image localization and acoustic diffusion according to the arrangement of speakers by a user. The following will describe embodiments of the present invention with reference to the drawings. Note that a speaker herein refers to a Loudspeaker. A figure combining a trapezoidal shape and a rectangle shape as illustrated with "202" in FIG. 2B herein indicates a speaker unit, and an enclosure of a speaker is not illustrated unless explicitly mentioned otherwise. Note that a configuration excluding the audio output unit from the speaker system is referred to as an audio signal rendering apparatus.

First Embodiment

Figure 1:
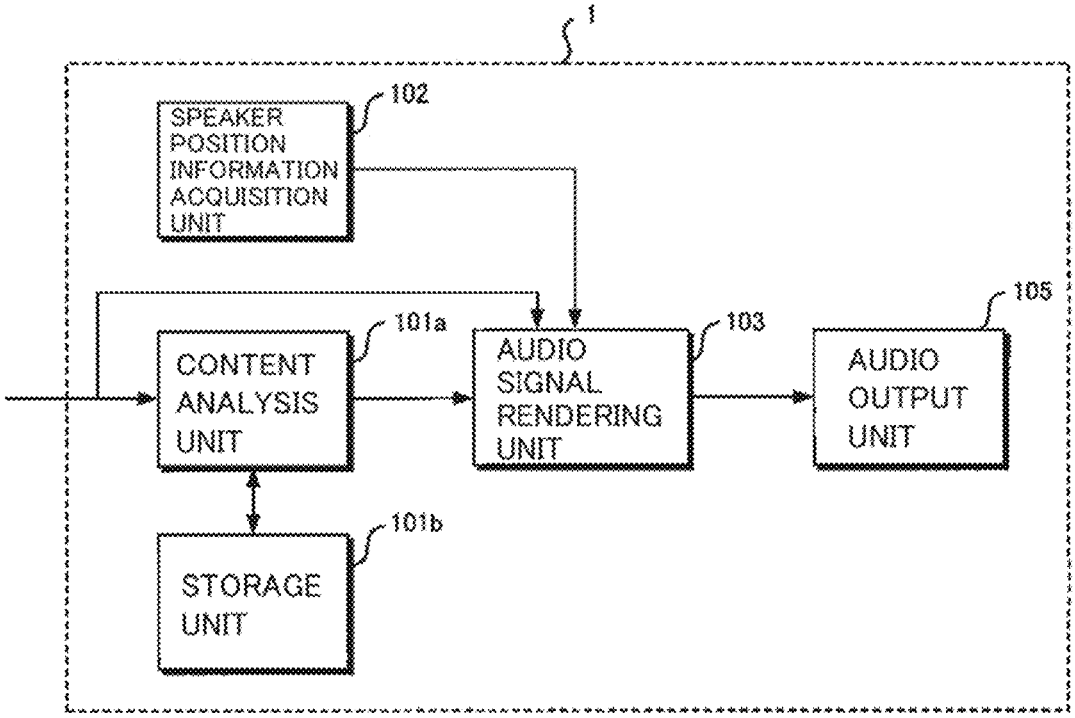
FIG. 1 is a block diagram illustrating a main configuration of a speaker system according to a first embodiment of the present invention.

FIG. 1 is a block diagram illustrating a schematic configuration of a speaker system 1 according to a first embodiment of the present invention. The speaker system 1 according to the first embodiment is a system that analyzes a feature quantity of a content to be reproduced and performs preferable audio rendering to reproduce the content in consideration of the analysis result, as well as, the arrangement of the speaker system. As illustrated in FIG. 1, a content analysis unit 101*a* analyzes audio signals and associated metadata included in video contents or audio contents recorded in a disc media, such as a DVD or a BD, a Hard Disc Drive (HDD) and the like. A storage unit 101*b* stores the analysis result acquired from the content analysis unit 101*a*, information obtained from a speaker position information acquisition unit 102, as will be described later, and a variety of parameters that are necessary for content analysis and the like. The speaker position information acquisition unit 102 obtains the present arrangement of speakers.

An audio signal rendering unit 103 renders and recomposes input audio signals appropriately for each speaker, based on the information obtained from the content analysis unit 101*a* and the speaker position information acquisition unit 102. An audio output unit 105 includes multiple speaker units and outputs the audio signals on which signal processing is performed as physical vibrations.

Content Analysis Unit 101*a*

The content analysis unit 101*a* analyzes a sound track included in a content to be reproduced and associated arbitrary metadata, and transmits the analyzed information to the audio signal rendering unit 103. In the present embodiment, it is assumed that the content for reproduction that the content analysis unit 101*a* receives is a content including one or more sound tracks. This sound track is assumed to be one of roughly classified two kinds of sound tracks: a "channel-based" sound track that is employed in stereo (2 ch), 5.1 ch and the like; and an "object-based" sound track where each sound generating object unit is defined as one track and associated information that describes positional and volume variation of this track at arbitrary time is added.

The concept of an object-based sound track will be described. The object-based sound track records audio in units of sound-generating objects on tracks, in other words, records the audio without mixing, and a player (a reproduction machine) side renders the sound generating object appropriately. Although differences exist among different standards, in principle, the sound generating object is associated with metadata (associated information), such as when, where, and how large sound should be generated, based on which the player renders each sound generating object.

On the other hand, the channel-based track is employed in conventional surround audio and the like. The track records audio in a state where sound generating objects are mixed with an assumption that the sound is generated from a predefined reproduction position (speaker arrangement).

Figures 4, 5A:
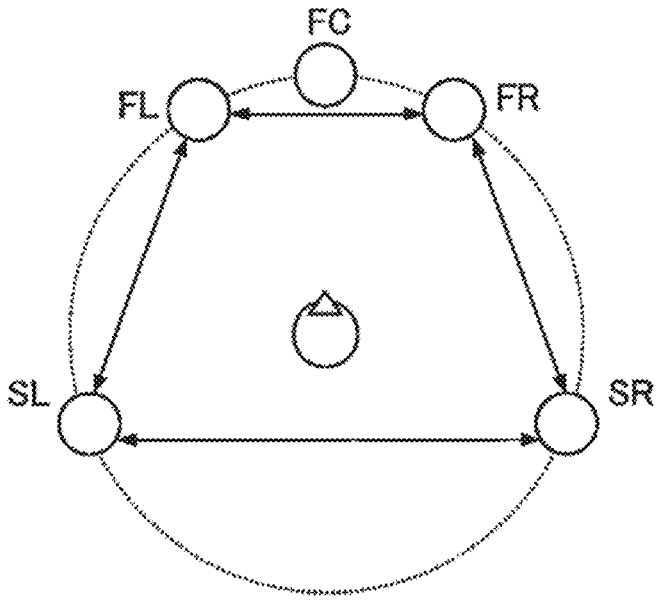
FIG. 4 is a diagram illustrating an example of track information that is used by the speaker system according to the first embodiment of the present invention.
FIG. 5A is a diagram illustrating an example of pairs of neighboring channels in the first embodiment of the present invention.

The content analysis unit 101*a* analyzes all the sound tracks included in a content and reconstructs the sound tracks as track information 401 as illustrated in FIG. 4. The track information 401 records each sound track ID and the classification of the sound track. In a case that the sound track is an object-based track, the content analysis unit 101*a* analyzes the metadata of the track and records one or more pieces of sound generating object position information that include a pair of reproduction time and a position at the reproduction time.

On the other hand, in a case that the track is a channel-based track, the content analysis unit 101*a* records output channel information as Information indicating a track reproduction position. The output channel information is associated with a predefined arbitrary reproduction position information. In the present example, specific position information (e.g., coordinates) is not recorded in the track information 401. Instead, for example, reproduction position information of a channel-based track is recorded in advance in the storage unit 101*b*, and, at the time when the position information is required, specific position information that is associated with the output channel information is read from the storage unit 101*b* appropriately. It should be appreciated that specific position information may be recorded in the track information 401.

Figure 2A:
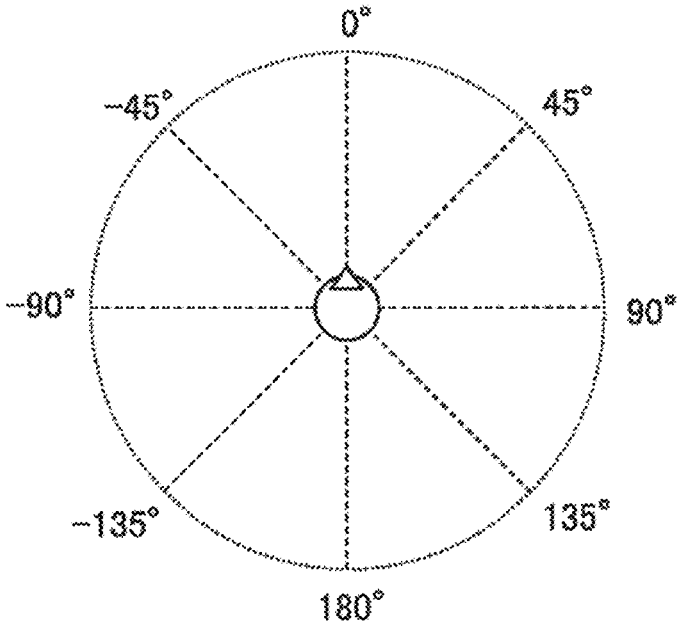
FIG. 2A is a diagram illustrating a coordinate system.

Here, the position information of a sound generating object is expressed in a coordinate system illustrated in FIG. 2A. In addition, the track information 401 is described in a markup language, such as Extensible Markup Language (XML), for example, in a content. After analyzing all the sound tracks included in the content, the content analysis unit 101*a* transmits the generated track information 401 to the audio signal rendering unit 103.

Note that, in the present embodiment, for better understanding of description, the position information of a sound generating object is assumed to be arranged in a coordinate system illustrated in FIG. 2A, in other words, on a concentric circle centering on a user, and only the angle is expressed in the coordinate system, but it should be appreciated that the position information may be expressed in a different coordinate system. For example, a two-dimensional or three-dimensional orthogonal coordinate system or polar coordinate system may instead be used.

Storage Unit 101*b*

The storage unit 101*b* is constituted by a secondary storage device for recording a variety of data used by the content analysis unit 101*a*. The storage unit 101*b* is constituted by, for example, a magnetic disk, an optical disk, a flash memory, or the like, and, more specifically, constituted by a HDD, a Solid State Drive (SSD), an SD memory card, a BD, a DVD, or the like. The content analysis unit 101*a* reads data from the storage unit 101*b* as necessary. In addition, a variety of parameter data including the analysis result may be recorded in the storage unit 101*b*.

Speaker Position Information Acquisition Unit 102

Figure 7A:
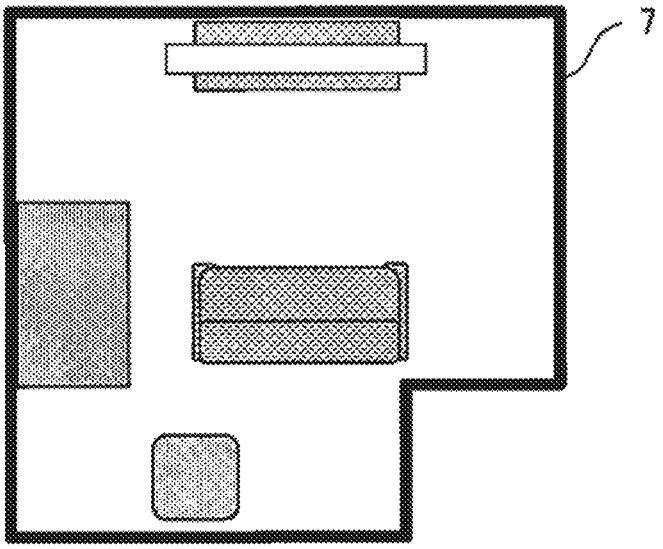
FIG. 7A is a diagram illustrating an example of a model of audio-visual room information.
Figure 7B:
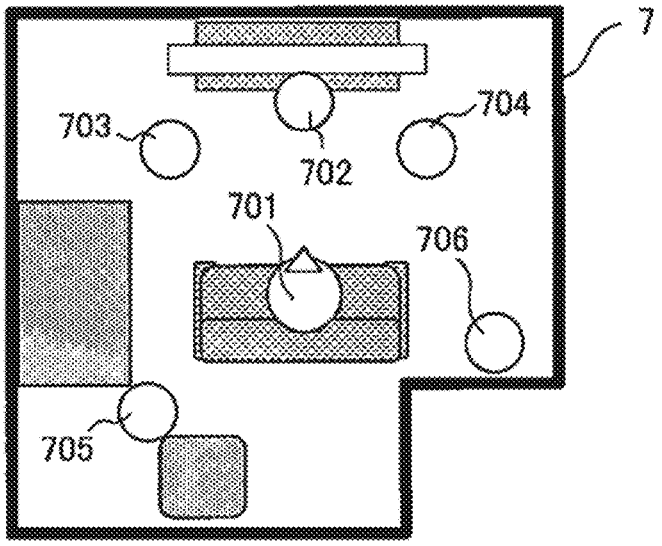
FIG. 7B is a diagram illustrating an example of a model of audio-visual room information.

The speaker position information acquisition unit 102 obtains the arrangement position of each audio output unit 105 (speaker) as will be described later. The speaker position is obtained by presenting previously modeled audio-visual room information 7 on a tablet terminal or the like as illustrated in FIG. 7A and allowing a user to input a user position 701, speaker positions 702, 703, 704, 705, and 706 as illustrated in FIG. 7B. The speaker position is obtained as position information in the coordinate system illustrated in FIG. 2A with the user position as the center.

Further, as an alternative acquisition method, the positions of the audio output units 105 may be automatically calculated by image-processing (for example, the top of each audio output unit 105 is marked for recognition) an image captured by a camera installed on a ceiling of the room. Alternatively, as described in PTL 1 or the like, sound of an arbitrary signal may be generated from each audio output unit 105, the sound may be measured by one or multiple microphones that are arranged at a viewing and listening position of a user, and the position of each audio output unit 105 may be calculated based on a difference or the like between time of generating the sound and time of actually measuring the sound.

Figure 13:
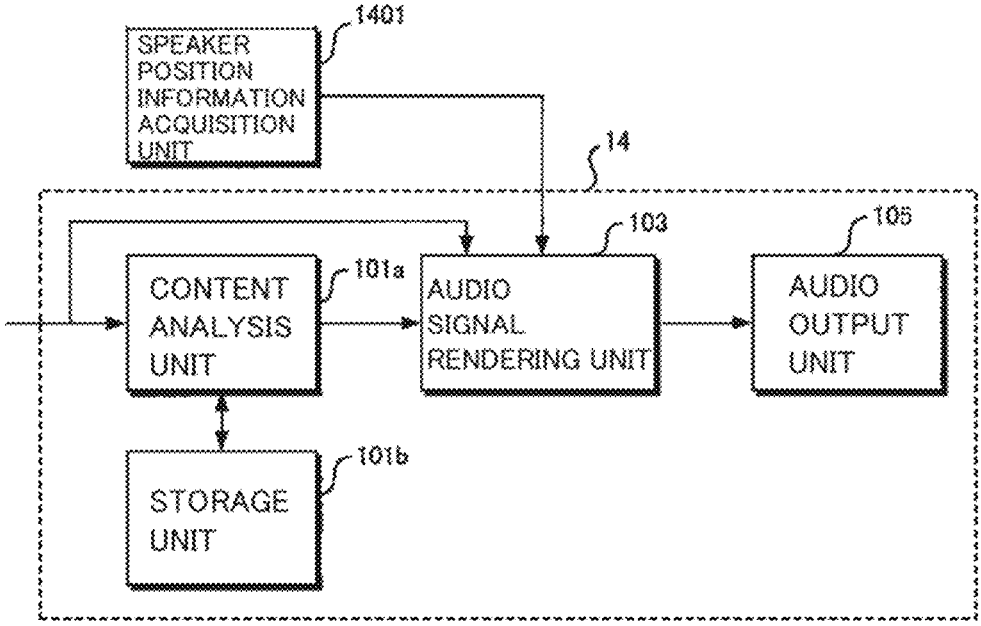
FIG. 13 is a block diagram illustrating a schematic configuration of a variation of the speaker system according to the first embodiment of the present invention.
Figure 14:
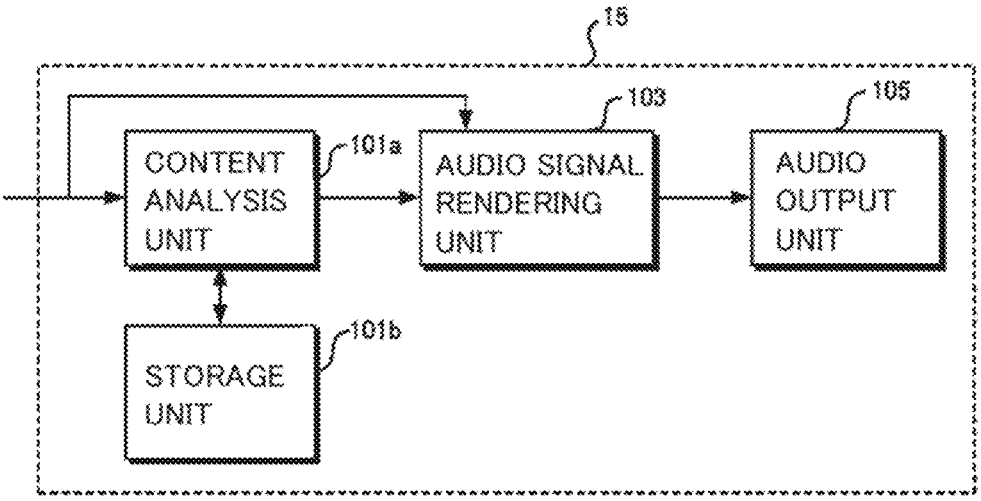
FIG. 14 is a block diagram illustrating a schematic configuration of a variation of the speaker system according to the first embodiment of the present invention.

In the present embodiment, description is made for the system including the speaker position information acquisition unit 102, but the system may be constituted in such a manner that speaker position information acquisition unit 1401 may be obtained from an external system, as illustrated as the speaker system 14 in FIG. 13. Alternatively, the speaker positions may be assumed as being located in advance at any known positions, and the speaker position information acquisition unit may be eliminated as illustrated as the speaker system 15 in FIG. 14. In such a case, the speaker positions are prerecorded in the storage unit 101*b*.

Audio Output Unit 105

Figure 11A:
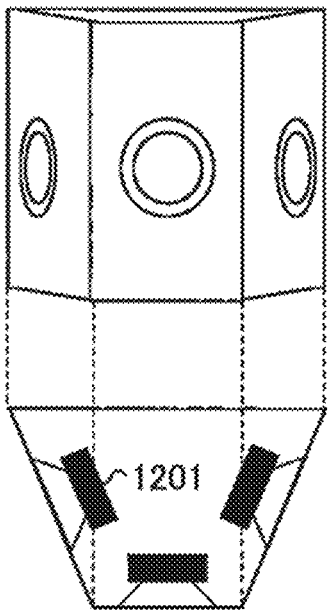
FIG. 11A is a diagram illustrating an example of the shape of an audio output unit of the speaker system according to the first embodiment of the present invention.
Figure 11B:
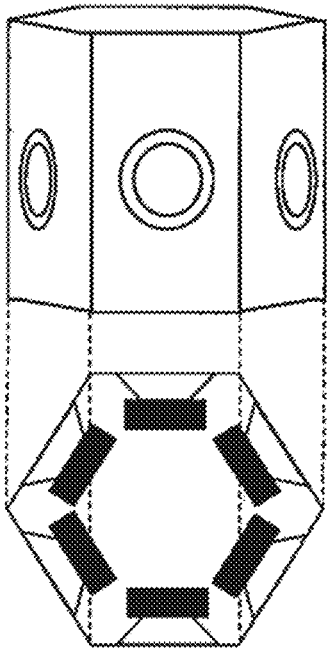
FIG. 11B is a diagram illustrating an example of the shape of the audio output unit of the speaker system according to the first embodiment of the present invention.
Figure 11C:
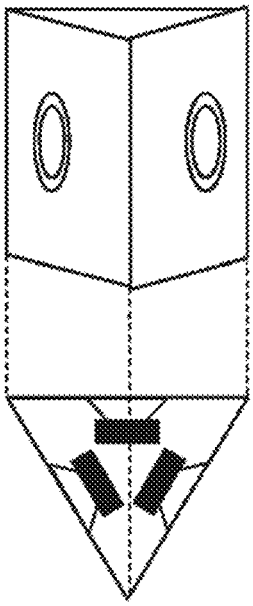
FIG. 11C is a diagram illustrating an example of the shape of the audio output unit of the speaker system according to the first embodiment of the present invention.
Figure 11D:
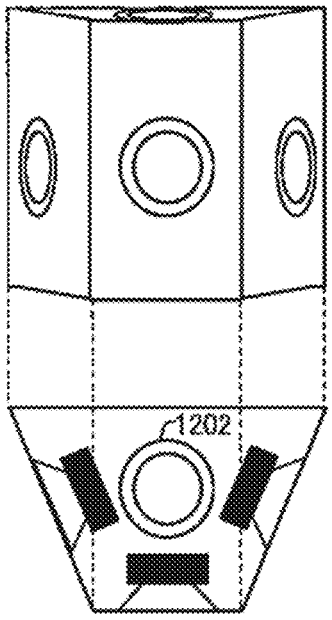
FIG. 11D is a diagram illustrating an example of the shape of the audio output unit of the speaker system according to the first embodiment of the present invention.
Figure 11E:
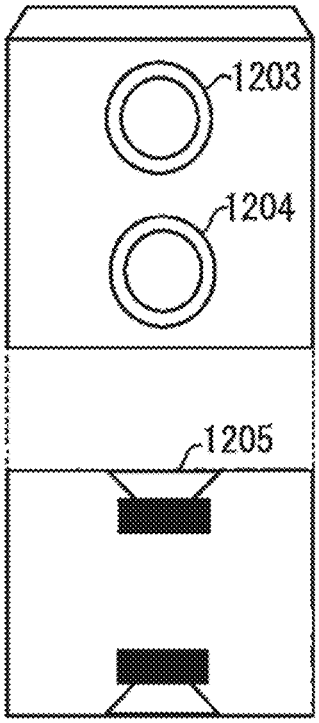
FIG. 11E is a diagram illustrating an example of the shape of the audio output unit of the speaker system according to the first embodiment of the present invention.

The audio output unit 105 outputs audio signals processed by the audio signal rendering unit 103 in FIGS. 11A to 11E, the upper side in the paper is a perspective view illustrating a speaker enclosure (case), in which the speaker units are illustrated by double circles. Further, in FIGS. 11A to 11E, the lower side in the paper is a plane view conceptually illustrating the positional relationship of speaker units, and illustrates the arrangement of the speaker units. As illustrated in FIGS. 11A to 11E, each audio output unit 105 includes at least two or more speaker units 1201, and the speaker units are arranged so that at least one speaker unit is oriented in a direction different from orientation of the other speaker units. For example, as illustrated in FIG. HA, the speaker enclosure (case) may be a quadrangular prism with a trapezoidal shape base, and the speaker units may be arranged on the three faces of the speaker enclosure. Alternatively, the speaker enclosure may be a hexagonal pole as illustrated in FIG. 11B or a triangular pole as illustrated in FIG. 11C, and six or three units may be arranged in the speaker enclosures, respectively. Further, as illustrated in FIG. 11D, a speaker unit 1202 (indicated by a double circle) may be arranged facing upward, or, as illustrated in FIG. 11E, speaker units 1203 and 1204 may be oriented in the same direction and a speaker unit 1205 may be oriented in a different direction from the direction of these speaker units 1203 and 1204.

In the present embodiment, the shape of the audio output units 105 and the number and orientation of the speaker units are recorded in the storage unit 101.*b* in advance as known information.

Further, the front direction of each audio output unit 105 is determined in advance, and a speaker unit that faces the front direction is defined as the "sound image localization effect enhancing speaker unit" and another speaker unit(s) is defined as the "surround effect enhancing speaker unit," and such information is stored in advance in the storage unit 101*b* as known information.

Note that, in the present embodiment, both "sound image localization effect enhancing speaker unit" and "surround effect enhancing speaker unit" are described as speaker units with directivity of some degree, but a non-directive speaker unit may be used especially for the "surround effect enhancing speaker unit." Further, in a case that a user arranges the audio output units 105 at an arbitrary positions, each audio output unit 105 is arranged in a manner that the predetermined front direction is oriented toward the user side.

In the present embodiment, the sound image localization effect enhancing speaker unit that faces the user side can provide a clear direct sound to a user, and thus the speaker unit is defined to output audio signals that mainly enhance sound image localization. On the other hand, the "surround effect enhancing speaker unit" that is oriented in a direction different from a user can provide sound diffusedly to a user utilizing reflection against walls, ceiling, and the like, and thus the speaker unit is defined to output audio signals that mainly enhance a sound surround effect and a sound expansion effect.

Audio Signal Rendering Unit 103

The audio signal rendering unit 103 constructs audio signals to be output from each audio output unit 105, based on the track information 401 acquired by the content analysis unit 101*a* and the position information of the audio output unit 105 acquired by the speaker position information acquisition unit 102.

Next, the operation of the audio signal rendering unit will be described in detail using a flowchart illustrated in FIG. 8. In a case that the audio signal rendering unit 103 receives an arbitrary sound track and the associated information, processing starts (step S101), Track information 401 acquired by the content analysis unit 101*a* is referred to, and the processing is branched according to the classification of each track that has been input into the audio signal rendering unit 103 (step S102). In a case that the track classification is channel based (YES at step S102), surround effect enhancing rendering processing (described later) is performed (step S105), and whether the processing has been performed for all the track is checked (step S107). In a case that there is an unprocessed track (NO at step S107), the processing from step S102 is applied again to the unprocessed track. At step S107, in a case that the processing has been completed for all the tracks that the audio signal rendering unit 103 has been received (YES at step S107), the processing is terminated (step S108).

On the other hand, in a case that the track classification is object based at step S102 (NO at step S102), the position information of this track at the present time is obtained by referring to the track information 401 and immediately neighboring two speakers in the positional relationship of sandwiching the acquired track are selected by referring to the position information of the audio output units 105 acquired by the speaker position information acquisition unit 102 (step S103).

Figure 9A:
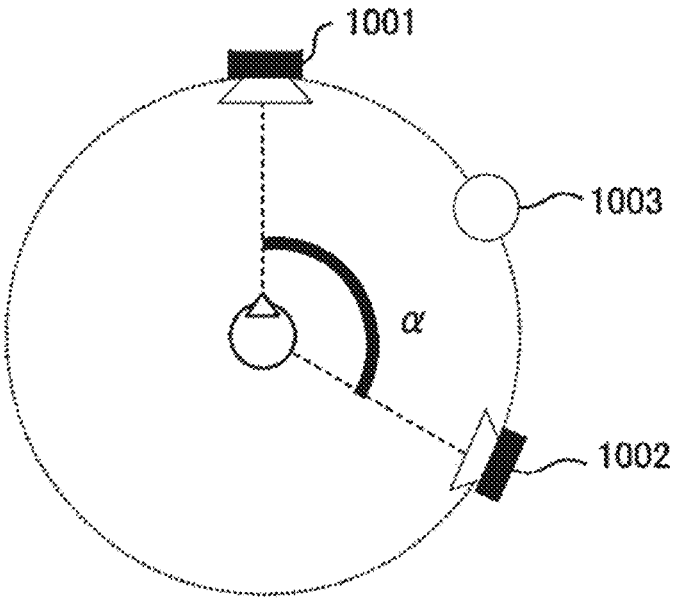
FIG. 9A is a diagram illustrating an example of a position of a track and two speakers that sandwich the track.
Figure 9B:
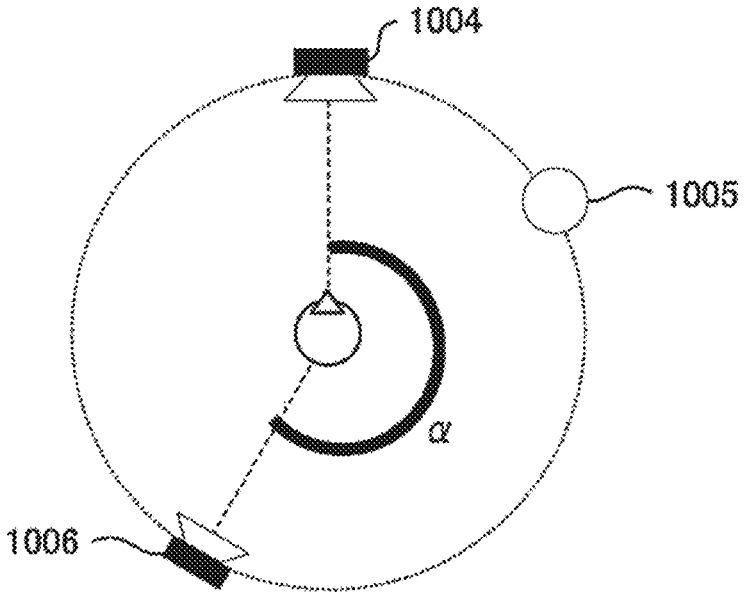
FIG. 9B is a diagram illustrating an example of a position of a track and two speakers that sandwich the track.

As illustrated in FIG. 9A, in a case that a sound generating object in a track is located at a position 1003 and immediately neighboring two speakers that sandwich the track (position 1003) are located at 1001 and 1002, an angle between the speakers 1001 and 1002 is calculated as a, and whether the angle α is less than 180° is determined (step S104). In a case that a is less than 180° (YES at step S104), the sound image localization enhancing rendering processing (described later) is performed (step S106*a*). As illustrated in FIG. 9B, in a case that the sound generating object in a track is located at a position 1005 and immediately neighboring two speakers that sandwich the track (position 1005) are located at 1004 and 1006, and an angle α between the two speakers 1004, 1006 is equal to or more than 180° (NO at step S104), sound image localization complement rendering (described later) is performed (step S106*b*).

Figure 8:
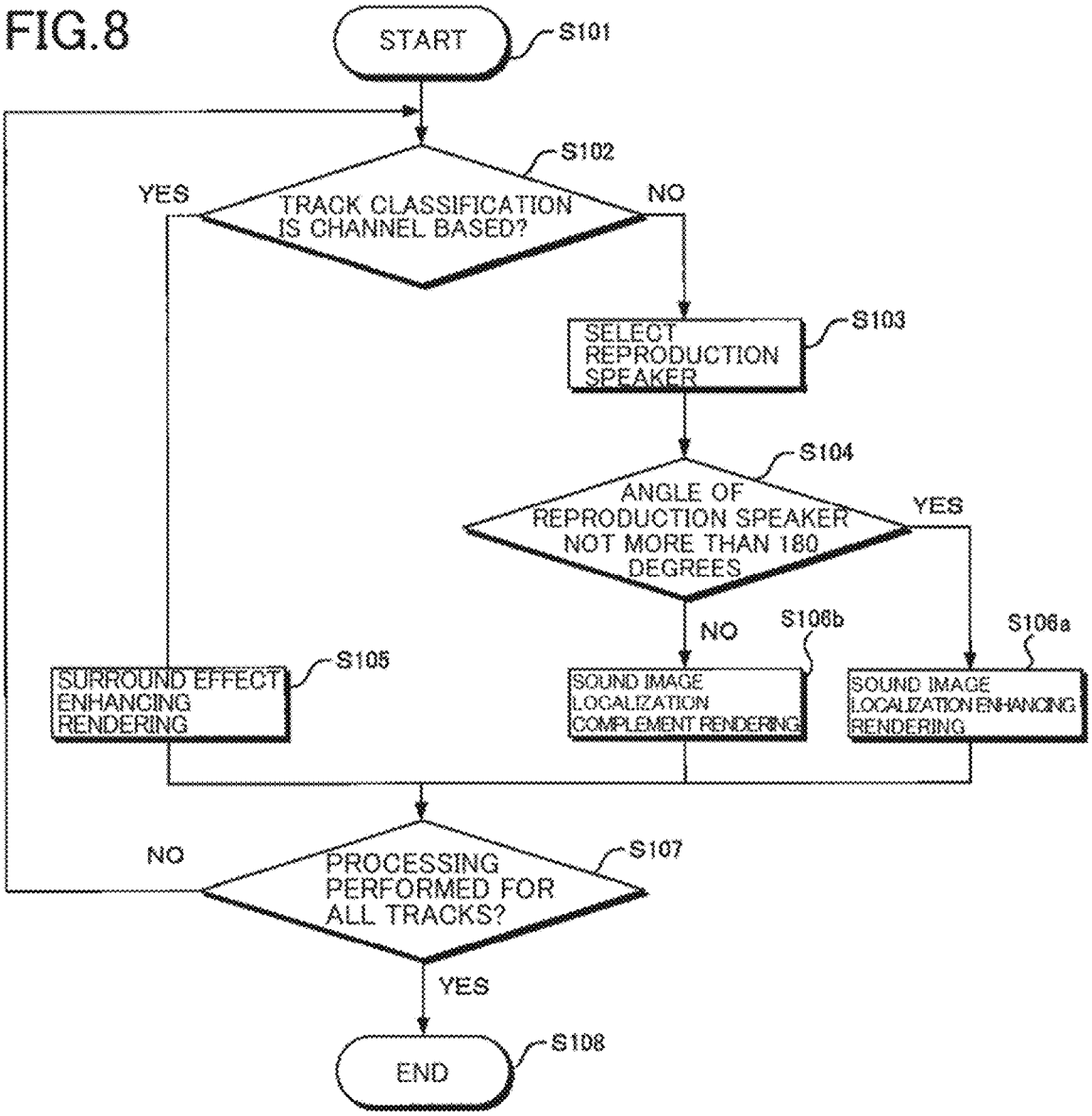
FIG. 8 is a diagram illustrating a processing flow of the speaker system according to the first embodiment of the present invention.

It will be appreciated that, the sound track that the audio signal rendering unit 103 receives at one time may include all the data from the start to end of the content, but the content may be cut into the length of arbitrary unit time, and the processing illustrated in the flowchart of FIG. 8 may be repeated for the unit time.

Figure 12A:
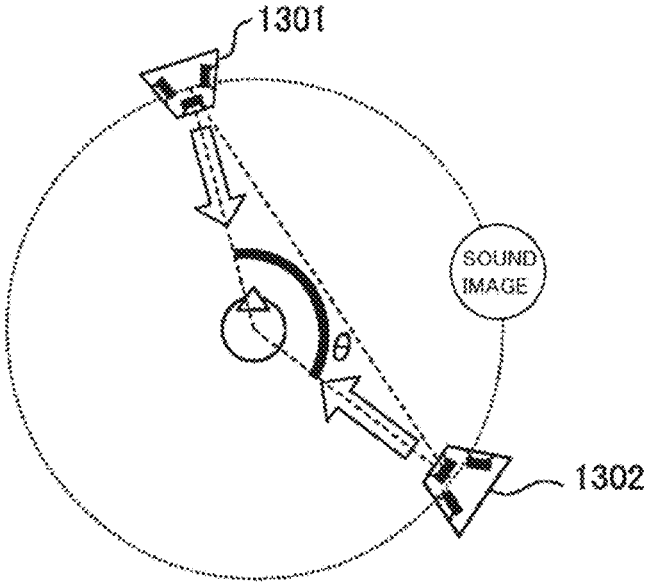
FIG. 12A is a schematic view illustrating a sound rendering method of the speaker system according to the first embodiment of the present invention.

The sound image localization enhancing rendering processing is processing that is applied to a track related to a sound image localization effect in an audio content. More specifically, the sound image localization effect enhancing speaker unit of each audio output unit 105, in other words, the speaker unit facing the user side, is used to bring audio signals more clearly to a user, and thus the user is allowed to easily feel localization of a sound image (FIG. 12A). The track on which the rendering processing is applied is output by vector-based sound pressure panning, based on the positional relationship among the track and immediately neighboring two speakers.

Figure 10:
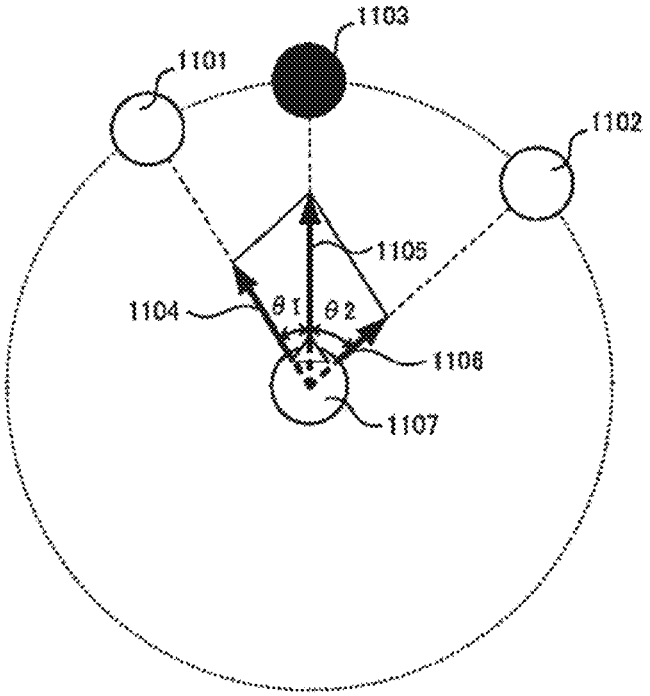
FIG. 10 is a diagram illustrating a concept of a vector-based sound pressure panning that is used for calculation in the speaker system according to the present embodiment.

The following will describe vector-based sound pressure panning in more detail. Here, it is assumed that, as illustrated in FIG. 10, a position at certain time in one track among a content is 1103. Further, in a case that the arrangement of the speakers obtained by the speaker position information acquisition unit 102 specifies 1101 and 1102 that sandwich the position 1103 of a sound generating object, the sound generating object is reproduced at the position 1103 by vector-based sound pressure panning using these speakers, for example, as described in reference document 2. Specifically, in a case that the strength of sound generated from the sound generating object to an audience 1107 is expressed by a vector 1105, this vector is decomposed into a vector 1104 between the audience 107 and the speaker located at the position 1101 and a vector 1106 between the audience 1107 and the speaker located at the position 1102, and ratios of the vectors 1104 and 1106 to the vector 1105 are calculated.

Specifically, in a case that the ratio of the vector 1104 to the vector 1105 is r1 and the ratio of the vector 1106 to the vector 1105 is r2, the ratios can be expressed as follows.

$$r1=\sin(\theta 2)/\sin(\theta 1+\theta 2)$$

$$r2=\cos(\theta 2)-\sin(\theta 2)/\tan(\theta 1+\theta 2)$$

Here, θ1 is an angle between the vectors 1104 and 1105, and θ2 is an angle between the vectors 1106 and 1105.

The audio signal generated from sound generating audio are multiplied by the calculated ratios and the results are reproduced from the speakers arranged at 1101 and 1102, respectively, whereby the audience can feel as if the sound generating object is reproduced from the position 1103. Performing the above processing to all the sound generating objects can generates the output audio signals.

Figure 3A:
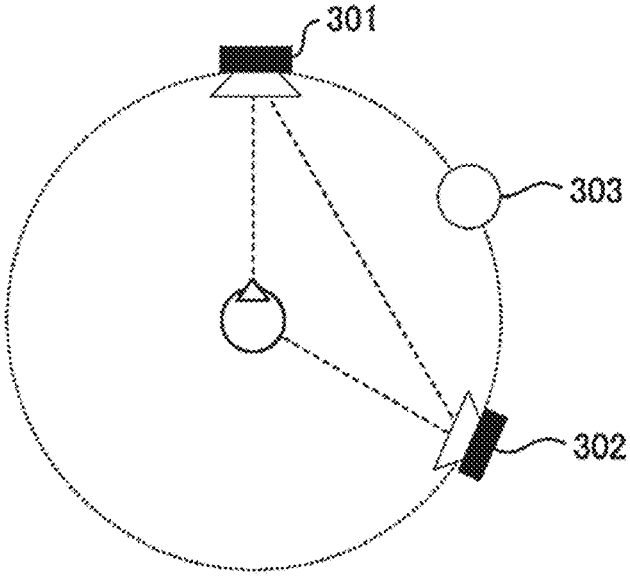
FIG. 3A is a diagram illustrating an example of a sound image and speakers that create the sound image.
Figure 3B:
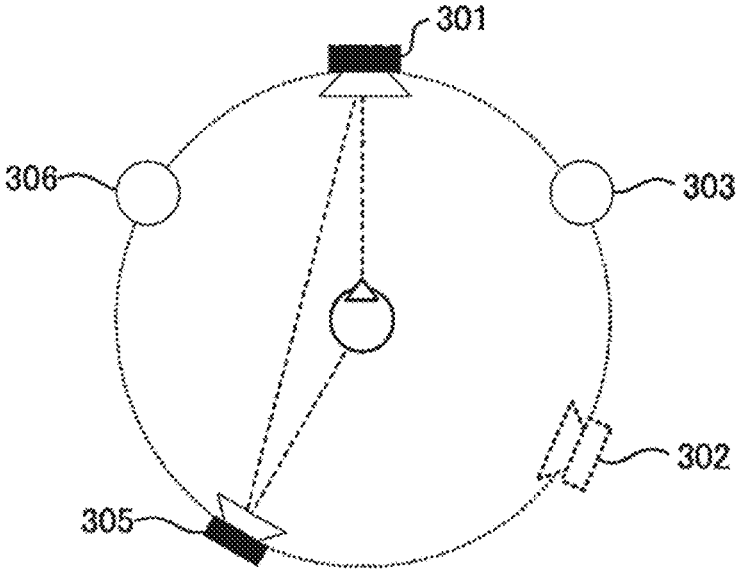
FIG. 3B is a diagram illustrating an example of a sound image and speakers that create the sound image.
Figure 12B:
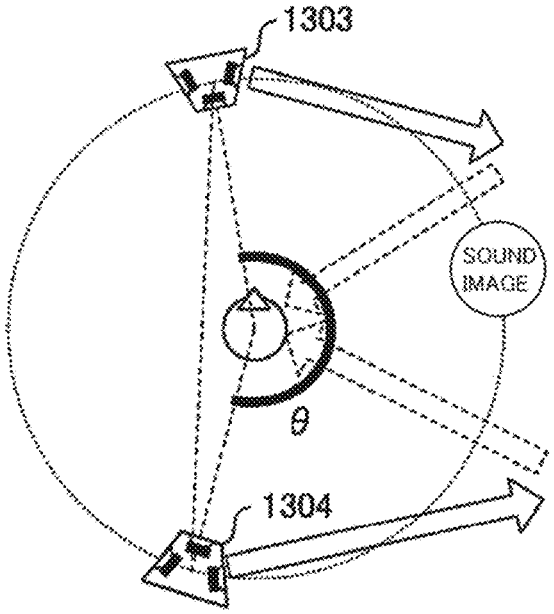
FIG. 12B is a schematic view illustrating a sound rendering method of the speaker system according to the first embodiment of the present invention.

The sound image localization complement rendering processing is also processing that is applied to a track related to a sound image localization effect in an audio content. However, as illustrated in FIG. 12B, a sound image cannot be created at a desired position by the sound image localization effect enhancing speaker units due to a positional relationship among the sound image and the speakers. In other words, as described with reference to FIGS. 3A and 3B, in this case, applying the sound image localization enhancing rendering processing causes a localization of a sound image on the left side of the user.

Figure 2B:
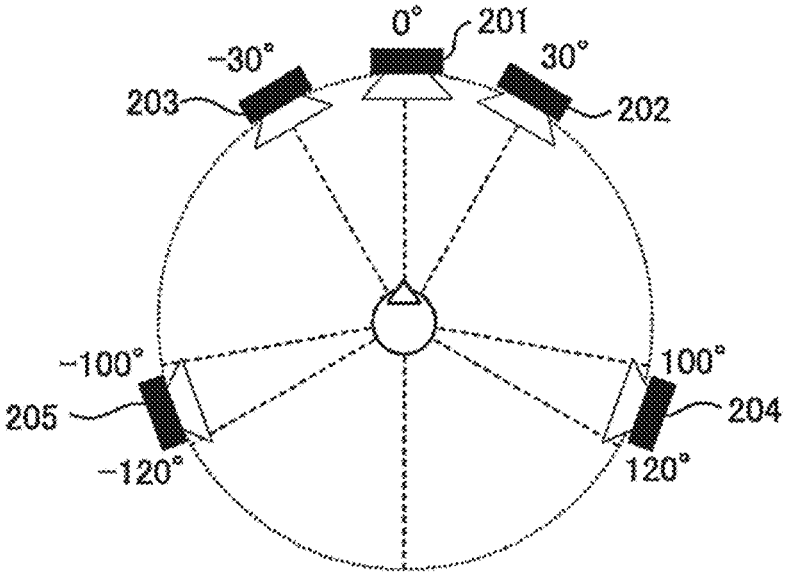
FIG. 2B is a diagram illustrating a coordinate system and channels.
Figure 12C:
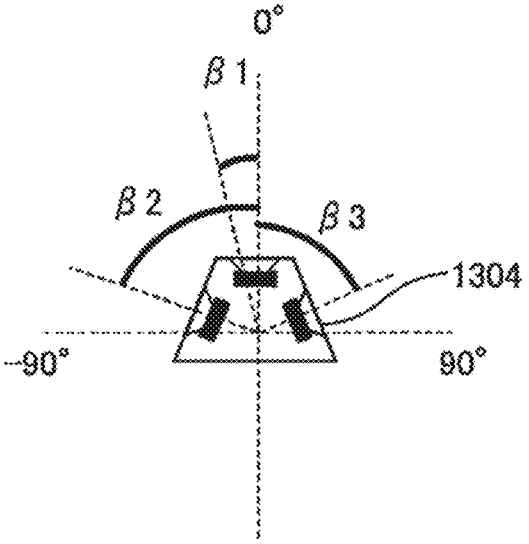
FIG. 12C is a schematic view illustrating a sound rendering method of the speaker system according to the first embodiment of the present invention.

In the present embodiment, in such a case, localization of a sound image is artificially formed by using the "surround effect enhancing speaker units." Here, the "surround effect enhancing speaker units" are selected based on the known orientation information of speaker units, and the selected units is used to create a sound image by the above-described vector-based sound pressure panning. As for the speaker unit to be selected, in an example of the audio output unit 1304 illustrated in FIG. 12C, assuming that a coordinate system where the front direction of the audio output unit, that is, the user direction is defined as 0° illustrated in FIGS. 2A and 2B is applied, and an angle with a straight line connecting the audio output units 1303 and 1304 is defined as β1 and angles with directions of the "surround effect enhancing speaker units" are defined as β2 and β3, the "surround effect enhancing speaker unit" located at the angle β3 having a different positive/negative sign from β1 is selected.

The surround effect enhancing rendering processing is processing that is applied to a track making little contribution to a sound image localization effect in an audio content and enhancing sound surround effect and sound expansion effect. In the present embodiment, the channel-based track is determined as not including audio signals relating to localization of a sound image but including audio that contributes to a sound surround effect and a sound expansion effect, and thus, surround effect enhancing rendering processing is applied to the channel-based track. In the processing, the target track is multiplied by a preconfigured arbitrary coefficient a, and the track is caused to be output from all the "surround effect enhancing speaker units" of the arbitrary audio output unit 105. Here, as for the audio output unit 105 for the output, the audio output unit 105 that is located nearest to a position associated with output channel information recorded in the track information 401 of the target track is selected.

Note that the sound image localization enhancing rendering processing and sound image localization complement rendering processing constitute first rendering processing, and the surround effect enhancing rendering processing constitutes second rendering processing.

As described above, in the present embodiment, a method of automatically switching a rendering method according to a positional relationship among audio output units and a sound source has been described, but the rendering method may be determined by different methods. For example, a user input means, such as a remote controller, a mouse, a key board, or a touch panel, (not illustrated) may be provided on the speaker system 1, through which a user may select a "sound image localization enhancing rendering processing" mode, a "sound image localization complement rendering processing" mode, or a "surround effect enhancing rendering processing" mode. At this time, a mode may be individually selected for each track, or a mode may be collectively selected for all the tracks. In addition, ratios of the above-described three modes may be explicitly input, and in a case that the ratio of the "sound image localization enhancing rendering processing" mode is higher, the number of tracks allocated to the "sound image localization enhancing rendering processing" may be increased, while, in a case that the ratio of the "surround effect enhancing rendering processing" mode is higher, the number of tracks allocated to the "surround effect enhancing rendering processing" may be increased.

Furthermore, the rendering processing may be determined, for example, using layout information of a house that is separately measured. For example, in a case that it is determined that walls or the like reflecting sound do not exist in a direction in which the "surround effect enhancing speaker unit" included in the audio output unit is oriented (i.e., audio output direction), based on the layout information and the position information of the audio output unit that have previously been acquired, the sound image localization complement rendering processing that is realized using the speaker unit may be switched to the surround effect enhancing rendering processing.

As described above, audio that has both sound localization effect and sound surround effect can be brought to a user by reproducing audio by automatically calculating a preferable rendering method using speakers including both functions of sound image localization and acoustic diffusion according to the arrangement of the speakers arranged by a user.

Second Embodiment

The first embodiment has been described on the assumption that an audio content received by the content analysis unit 101*a* includes both channel-based and object-based tracks and the channel-based track does not include audio signals of which sound image localization effect is to be enhanced. However, in a second embodiment, the operation of the content analysis unit 101*a* in a case that only channel-based tracks are included in an audio content or in a case that the channel-based track includes audio signals of which sound image localization effect is to be enhanced will be described. Note that the second embodiment is different from the first embodiment only in the behavior of the content analysis unit 101*a*, and thus, description of other processing units will be omitted.

For example, in a case that the audio content received by the content analysis unit 101*a* is 5.1 ch audio, a sound image localization calculation technique based on correlation information between two channels as disclosed in PTL 2 is applied and a similar histogram is generated based on the following procedure. Correlations between neighboring channels are calculated for channels included in 5.1 ch audio other than a channel for Low Frequency Effect (LFE). The pairs of neighboring channels for the 5.1 ch audio signals are four pairs, FR and FL, FR and SR, FL and SI, and SL and SR, as illustrated in FIG. 5A. Here, as for the correlation information of the neighboring channels, correlation coefficients $d^{(i)}$ over f number of frequency bands that are arbitrarily quantized for unit time n are calculated, and, based on the coefficients, a sound image localization position θ for each of the f number of frequency bands is calculated (refer to Equation (36) in PTL 2).

Figure 6:
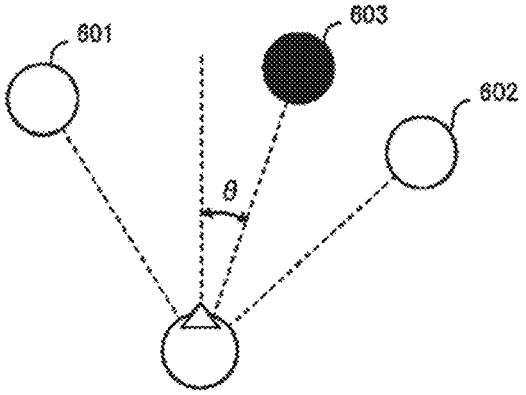
FIG. 6 is a schematic view illustrating a calculation result of a virtual sound image position.

For example, as illustrated in FIG. 6, a sound image localization position 603 based on a correlation between FL 601 and FR 602 is represented as θ with reference to the center of an angle between FL 601 and FR 602. In the present embodiment, quantized audio of each of f number of frequency bands is regarded as a single sound track, and, in unit time of audio in respective frequency bands, a time period with correlation coefficient values $d^{(i)}$ equal to or more than a preconfigured threshold Th_d is categorized as the object-based track and other time period(s) is categorized as a channel-based track. In other words, assume that the number of pairs of neighboring channels for which a correlation is calculated is defined as N, and the number of quantization of frequency hands is defined as f, the sound tracks are classified as 2*N*f number of sound tracks. As described above, reference of θ calculated as a sound image localization position is the center of the sound source positions that sandwich θ (or sound image localization position), θ is converted into a coordinate system illustrated in FIG. 2A appropriately.

The above-described processing is performed in the same way for pairs other than FL and FR, and a pair of a sound track and corresponding track information 401 is transmitted to the audio signal rendering unit 103.

Figure 5B:
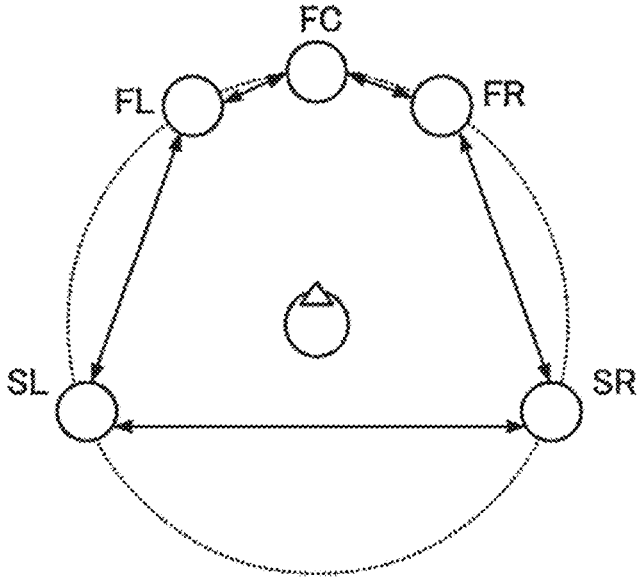
FIG. 5B is a diagram illustrating an example of pairs of neighboring channels in the first embodiment of the present invention.

Note that, in the above description, as disclosed in PTL 2, a FC channel to which mainly speech voice of people and the like is allocated is excluded from correlation calculation targets as there is few occasion where sound pressure control is performed to generate a sound image between the FC channel and FL or the FC channel and FR, and a correlation between FL and FR is instead been considered. However, it should be appreciated that correlations including FC may be considered to calculate a histogram, and, as illustrated in FIG. 5B, track information may be generated with the above-described calculation method for five pairs of correlations, FC and FR, FC and FL, FR and SR, FL and SL, and SL and SR.

As described above, audio that has both sound localization effect and sound surround effect can be brought to a user by reproducing audio by automatically calculating a preferable rendering method using speakers including both functions of sound image localization and acoustic diffusion according to the arrangement of the speakers arranged by a user and by analyzing the content of channel-based audio that is given as input.

Third Embodiment

Figure 15:
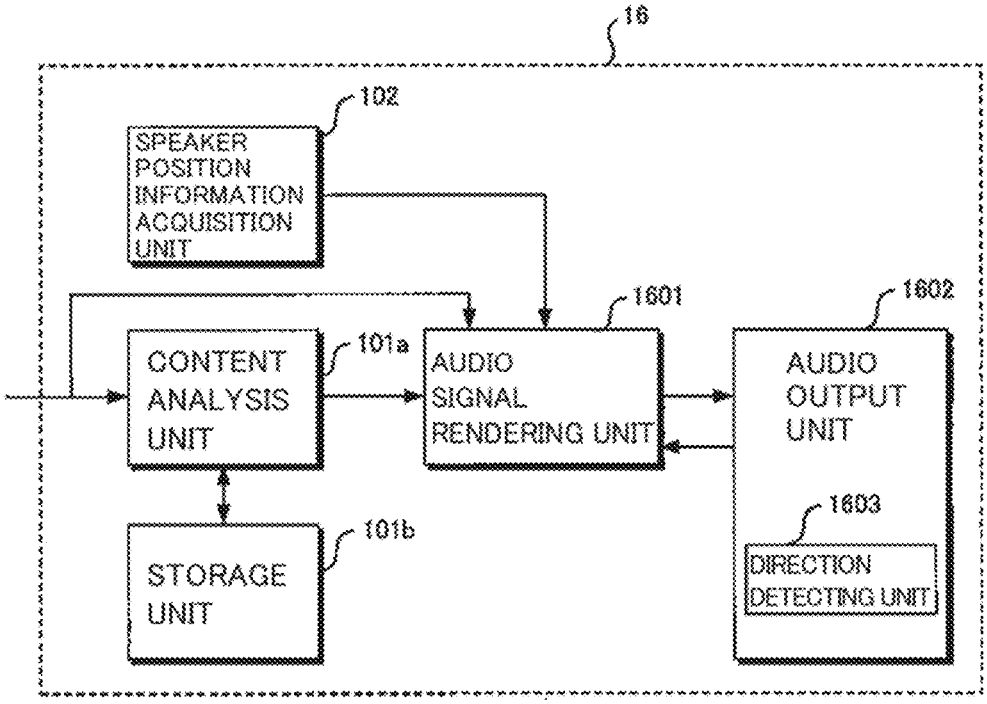
FIG. 15 is a block diagram illustrating a main configuration of a speaker system according to a third embodiment of the present invention.

In the first embodiment, the front direction of the audio output unit 105 is determined in advance and the front direction of the audio output unit is oriented toward the user side when the audio output unit is installed. However, as a speaker system 16 of FIG. 15, an audio output unit 1602 may notify the orientation information of audio output unit itself to an audio signal rendering unit 1601, and the audio signal rendering unit 1601 may perform audio rendering based on the orientation information for a user position. In other words, as illustrated in FIG. 15, in the speaker system 16 according to a third embodiment of the present invention, the content analysis unit 101*a* analyzes audio signals and associated metadata included in a video content or an audio content recorded in a disc media, such as a DVD or a BD, a Hard Disc Drive (HDD) or the like. The storage unit 101*b* stores an analysis result acquired from the content analysis unit 101*a*, information obtained from the speaker position information acquisition unit 102, and a variety of parameters that are required for content analysis and the like. The speaker position information acquisition unit 102 obtains the present arrangement of speakers.

The audio signal rendering unit 1601 renders and recomposes input audio signals for each speaker appropriately, based on the information obtained from the content analysis unit 101*a* and the speaker position information acquisition unit 102. The audio output unit 1602 includes multiple speaker units, as well as, a direction detecting unit 1603 that obtains a direction in which the audio output unit itself is oriented. The audio output unit 1602 outputs the audio signals on which signal processing is applied as physical vibrations.

Figure 16:
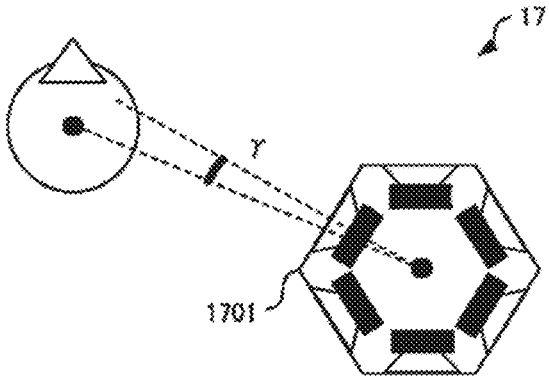
FIG. 16 is a diagram illustrating a positional relationship between a user and an audio output unit.

FIG. 16 is a diagram illustrating a positional relationship between a user and an audio output unit. As illustrated in FIG. 16, by defining a straight line connecting the user and the audio output unit as a reference axis, the orientation γ of each speaker unit is calculated. Here, the audio signal rendering unit 1601 recognizes a speaker unit 1701 with the smallest calculated γ among all the speaker units as a speaker unit for outputting audio signals on which sound image localization enhancing rendering processing is applied, as well as, recognizes the other speaker units as speaker units for outputting audio signals on which surround effect enhancing processing is applied, and outputs the audio signals on which the processing described with regard to the audio signal rendering unit 103 of the first embodiment is applied through each speaker unit.

Note that the user position that is required in this process is obtained through a tablet terminal or the like, as has already been described with regard to the speaker position information acquisition unit 102. In addition, the orientation information of the audio output unit 1602 is obtained from the direction detecting unit 1603. The direction detecting unit 1603 is specifically implemented by a gyro sensor or a geomagnetic sensor.

As described above, audio that has both sound localization effect and sound "surround effect" can be brought to a user by automatically calculating a preferable rendering method using speakers including both functions of sound image localization and acoustic diffusion and the arrangement of the speakers arranged by a user and further automatically determining the orientations of the speakers and the role of each speaker.

(A) The present invention can take the following aspects. Specifically, a speaker system according to an aspect of the present invention is a speaker system for reproducing multi-channel audio signals. The speaker system includes: an audio output unit including multiple speaker units in which at least one of the speaker units is arranged in orientation different from orientation of the other speaker units; an analysis unit configured to identify a classification of a sound track for each sound track of input multi-channel audio signals; a speaker position information acquisition unit configured to obtain position information of each of the speaker units; and an audio signal rendering unit configured to select one of first rendering processing and second rendering processing according to the classification of the sound track and perform the selected first rendering processing or second rendering processing for each sound track by using the obtained position information of the speaker units. The audio output unit outputs, as physical vibrations, the audio signals of the sound track on which the first rendering processing or the second rendering processing is performed.

In this way, audio that has both sound localization effect and sound "surround effect" can be brought to a user by identifying a classification of a sound track for each sound track of input multi-channel audio signals, acquiring position information of each speaker unit, selecting one of the first rendering processing and second rendering processing according to the classification of the sound track, performing the selected first rendering processing or second rendering processing for each sound track by using the position information of the obtained speaker unit, and outputting the audio signals of the sound track on which either the first rendering processing or second rendering processing is performed as physical vibrations through any of the speaker units.

(B) Further, in the speaker system according to an aspect of the present invention, the first rendering processing is performed by switching between, according to angles formed by orientations of the speaker units, sound image localization enhancing rendering processing that creates a clear sound generating object by using a speaker unit in charge of enhancing a sound image localization effect and sound image localization complement rendering processing that artificially forms a sound generating object by using a speaker unit not in charge of enhancing a sound image localization effect.

In this way, multi-channel audio signals can be more clearly brought to a user and the user can easily feel localization of a sound image, since the first rendering processing is performed by switching between, according to angles formed by orientations of the speaker units, the sound image localization enhancing rendering processing that creates the clear sound generating object by using the speaker unit in charge of enhancing the sound image localization effect and the sound image localization complement rendering processing that artificially forms the sound generating object by using the speaker unit not in charge of enhancing the sound image localization effect.

(C) In the speaker system according to an aspect of the present invention, the second rendering processing includes a surround effect enhancing rendering processing that creates an acoustic diffusion effect by using the speaker unit not in charge of enhancing the sound image localization effect.

In this way, a sound surround effect and a sound expansion effect can be provided to a user, since the second rendering processing includes the "surround effect enhancing rendering processing" that creates the acoustic diffusion effect by using the speaker unit not in charge of enhancing the sound image localization effect.

(D) In the speaker system according to an aspect of the present invention, based on an input operation by a user, the audio signal rendering unit, according to angles formed by the orientations of the speaker units, performs sound image localization enhancing rendering processing that creates a clear sound generating object by using a speaker unit in charge of enhancing a sound image localization effect, sound image localization complement rendering processing that artificially forms a sound generating object by using a speaker unit not in charge of enhancing a sound image localization effect, or surround effect enhancing rendering processing that creates an acoustic diffusion effect by using a speaker unit not in charge of enhancing a sound image localization effect.

With this configuration, a user can arbitrary select each rendering processing.

(E) In the speaker system according to an aspect of the present invention, the audio signal rendering unit performs the sound image localization enhancing rendering processing, the sound image localization complement rendering processing, or the surround effect enhancing rendering processing, according to the ratios input by a user.

With this configuration, a user can arbitrary select a ratio of performing each rendering processing.

(F) In the speaker system according to an aspect of the present invention, the analysis unit identifies a classification of each sound track as either object based or channel based, and, in a case that the classification of the sound track is object based, the audio signal rendering unit performs the first rendering processing, whereas in a case that the classification of the sound track is channel based, the audio signal rendering unit performs the second rendering processing.

With this configuration, rendering processing can be switched according to the classification of a sound track, and audio that has both sound localization effect and sound "surround effect" can be brought to a user.

(G) In the speaker system according to an aspect of the present invention, the analysis unit separates each sound track into multiple sound tracks, based on correlations between neighboring channels, identifies a classification of each separated sound track as either object based or channel based, and, in a case that the classification of the sound track is object based, the audio signal rendering unit performs the first rendering processing, whereas, in a case that the classification of the sound track is channel based, the audio signal rendering unit performs the second rendering processing.

In this way, the analysis unit identifies, based on correlations of neighboring channels, the classification of each sound track as either object based or channel based, and thus, audio that has both sound localization effect and sound "surround effect" can be brought to a user even in a case that only channel-based sound tracks are included in multi-channel audio signals or the channel-based sound tracks include audio signals of which sound image localization effect is to be enhanced.

(H) In the speaker system according to an aspect of the present invention, the audio output unit further includes a direction detecting unit configured to detect orientation of each speaker unit, and the rendering unit performs the selected first rendering processing or second rendering processing for each sound track by using information indicating the detected orientation of each speaker unit, and the audio output unit outputs audio signals of a sound track on which the first rendering processing or the second rendering processing is performed as physical vibrations.

In this way, audio that has both sound localization effect and sound "surround effect" can be brought to a user since the selected first rendering processing or second rendering processing is performed for each sound track by using information indicating the detected orientation of each speaker unit.

(I) Further, a program according to an aspect of the present invention is for a speaker system including multiple speaker units in which at least one of the speaker units is arranged in orientation different from orientation of the other speaker units. The program at least includes: a function of identifying a classification of a sound track for each sound track of input multi-channel audio signals; a function of obtaining position information of each of the speaker units; a function of selecting one of first rendering processing and second rendering processing according to the classification of the sound track and performing the selected first rendering processing or second rendering processing for each sound track by using the obtained position information of the speaker units; and a function of outputting audio signals of a sound track on which the first rendering processing or the second rendering processing is performed as physical vibrations through any of the speaker units.

In this way, audio that has both sound localization effect and sound "surround effect" can be brought to a user by identifying the classification of the sound track for each sound track of input multi-channel audio signals, obtaining position information of each of speaker units, selecting one of first rendering processing and second rendering processing according to the classification of the sound track, performing the selected first rendering processing or second rendering processing for each sound track by using the obtained position information of the speaker units, and outputting the audio signals of the sound track on which either the first rendering processing or the second rendering processing is performed as physical vibrations through any of the speaker units.

Implementation Examples by Software

The control blocks (in particular, the speaker position information acquisition unit 102, content analysis unit 101*a*, audio signal rendering unit 103) of the speaker systems 1 and 14 to 17 may be implemented by a logic circuit (hardware) formed on an integrated circuit (IC chip) or the like, or by software.

In the latter case, each of the speaker systems 1 and 14 to 17 includes a computer that performs instructions of a program being software for implementing each function. The computer includes, for example, one or more processors and a computer-readable recording medium stored with the above-described program. In the computer, the processor reads from the recording medium and performs the program to achieve the object of the present invention. As the above-described processor(s), a Central Processing Unit (CPU) can be used, for example. As the above-described recording medium, a "non-transitory tangible medium" such as a Read Only Memory (ROM) as well as a tape, a disk, a card, a semiconductor memory, and a programmable logic circuit can be used. A Random Access Memory (RAM) or the like in which the above-described program is developed may be further included. The above-described program may be supplied to the above-described computer via an arbitrary transmission medium (such as a communication network and a broadcast wave) capable of transmitting the program. Note that one aspect of the present invention may also be implemented in a form of a data signal embedded in a carrier wave in which the program is embodied by electronic transmission.

An aspect of the present invention is not limited to each of the above-described embodiments, various modifications are possible within the scope of the present invention defined by aspects, and embodiments that are made by suitably combining technical means disclosed according to the different embodiments are also included in the technical scope of an aspect of the present invention. Further, when technical elements disclosed in the respective embodiments are combined, it is possible to form a new technical feature.

CROSS-REFERENCE OF RELATED APPLICATION

This application claims the benefit of priority to JP 2016-109490 filed on May 31, 2016, which is incorporated herein by reference in its entirety.

REFERENCE SIGNS LIST

1, 14, 15, 16, 17 Speaker system
7 Audio-visual room information
101*a* Content analysis unit
101*b* Storage unit
102 Speaker position information acquisition unit
103 Audio signal rendering unit
105 Audio output unit
201 Center channel
202 Front right channel
203 Front left channel

204 Surround right channel
205 Surround left channel
301, 302, 305 Speaker position
303, 306 Sound image position
401 Track information
601, 602 Speaker position
603 Sound image localization position
701 User position
702, 703, 704, 705, 706 Speaker position
1001, 1002 Speaker position
1003 Sound generating object position in track
1004, 1006 Speaker position
1005 Sound generating object position in track
1101, 1102 Speaker arrangement
1103 Reproduction position of sound generating object
1104, 1105, 1106 Vector
1107 Audience
1201,1202,1203,1204,1205,1301,1302 Speaker unit
1303, 1304 Audio output unit
1401 Speaker position information acquisition unit
1601 Audio signal rendering unit
1602 Audio output unit
1603 Direction detecting unit
1701 Speaker unit

The invention claimed is:

1. A speaker system comprising:

at least two audio output units each including multiple speaker units, at least one of the speaker units being arranged in orientation different from orientation or orientations of the other speaker units in each of the at least two audio output units;

an audio signal rendering unit configured to perform rendering processing of generating audio signals to be output from each of the speaker units, based on input audio signals; and a speaker position information acquisition unit configured to obtain position information of each of the speaker units, wherein the audio signal rendering unit performs first rendering processing on a first audio signal included in the input audio signals and performs second rendering processing on a second audio signal included in the input audio signals, the first rendering processing is rendering processing that enhances a localization effect more than the second rendering processing does, the first rendering processing uses one of the speaker units facing the user side, and the multiple speaker units in each of the at least two audio output units include a speaker unit for enhancing a sound image localization effect and a speaker unit not for enhancing the sound image localization effect, and in a case of performing the first rendering processing, the audio signal rendering unit performs a rendering processing by switching to either sound image localization enhancing rendering processing that outputs audio signals from the speaker unit for enhancing the sound image localization effect or sound image localization complement rendering processing that outputs audio signals from the speaker unit not for enhancing the sound image localization effect, based on the position information of each of the speaker units and a position of a sound generating object in the first audio signal.

2. The speaker system according to claim 1, wherein the speaker unit for enhancing the sound image localization effect is a speaker unit oriented toward a user side, and the speaker unit not for enhancing the sound image localization effect is a speaker unit that is not oriented toward the user side.

3. The speaker system according to claim 1, wherein, in a case of performing the first rendering processing, the audio signal rendering unit performs sound pressure panning.

4. The speaker system according to claim 1, wherein, in a case of performing the second rendering processing, the audio signal rendering unit outputs audio signals from the speaker unit not for enhancing the sound image localization effect.

5. The speaker system according to claim 1, wherein each of the at least two audio output units further comprises a direction detecting unit configure to detect orientation of each of the speaker units in each of the at least two audio output units, and the audio signal rendering unit selects a speaker unit to be used for the first rendering processing and a speaker unit to be used for the second rendering processing, based on the orientation of each of the speaker units detected by the direction detecting unit.

6. The speaker system according to claim 1, wherein the audio signal rendering unit uses an object-based audio signal included in the input audio signals as the first audio signal and uses a channel-based audio signal included in the input audio signals as the second audio signal.

7. The speaker system according to claim 1, wherein, based on a correlation between neighboring channels, the audio signal rendering unit separates the input audio signals and identifies whether each separated audio signal is the first audio signal or the second audio signal.

8. The speaker system according to claim 1, wherein the audio signal rendering unit selects rendering processing, based on an input operation from a user.

9. A speaker system comprising:

at least two audio output units each including multiple speaker units, at least one of the speaker units being arranged in orientation different from orientation or orientations of the other speaker units in each of the at least two audio output units; and an audio signal rendering unit configured to perform rendering processing of generating audio signals to be output from each of the speaker units, based on input audio signals, wherein the audio signal rendering unit performs first rendering processing on a first audio signal included in the input audio signals and performs second rendering processing on a second audio signal included in the input audio signals, the first rendering processing is rendering processing that enhances a localization effect more than the second rendering processing does, and in a case of performing the first rendering processing, the audio signal rendering unit outputs audio signals by switching each of the speaker units, based on a position of a sound generating object in the first audio signal and an angle between two audio output units against a user position, the two audio output units being two of the at least two audio output units and sandwiching the object immediately neighboring.

* * * * *